US009598982B2

(12) United States Patent
Kurisu

(10) Patent No.: US 9,598,982 B2
(45) Date of Patent: Mar. 21, 2017

(54) VALVE TIMING ADJUSTING DEVICE

(71) Applicant: DENSO CORPORATION, Kariya, Aichi-pref. (JP)

(72) Inventor: Masao Kurisu, Anjo (JP)

(73) Assignee: DENSO CORPORATION, Kariya (JP)

( * ) Notice: Subject to any disclaimer, the term of this patent is extended or adjusted under 35 U.S.C. 154(b) by 103 days.

(21) Appl. No.: 14/490,086

(22) Filed: Sep. 18, 2014

(65) Prior Publication Data

US 2015/0075462 A1 Mar. 19, 2015

(30) Foreign Application Priority Data

Sep. 18, 2013 (JP) ..... 2013-193105

(51) Int. Cl.

| | |
|---|---|
| ***F01L 1/46*** | (2006.01) |
| ***F01L 1/02*** | (2006.01) |
| ***F01L 1/34*** | (2006.01) |
| ***F01L 1/352*** | (2006.01) |
| *F01L 1/053* | (2006.01) |

(52) U.S. Cl.

CPC ..... *F01L 1/026* (2013.01); *F01L 1/34* (2013.01); *F01L 1/352* (2013.01); *F01L 2001/0537* (2013.01); *F01L 2103/00* (2013.01); *F01L 2250/04* (2013.01); *F01L 2820/032* (2013.01); *F01L 2820/041* (2013.01); *F01L 2820/042* (2013.01)

(58) Field of Classification Search

CPC ..... F01L 1/34403; F01L 1/344; F01L 1/34; F01L 1/344

USPC ..... 123/90.17

See application file for complete search history.

(56) References Cited

U.S. PATENT DOCUMENTS

2010/0095920 A1* 4/2010 Morishima ..... F01L 1/344 123/90.17

2011/0265747 A1* 11/2011 Tadokoro ..... F01L 1/344 123/90.15

(Continued)

FOREIGN PATENT DOCUMENTS

| | | |
|---|---|---|
| JP | 2010-242721 | 10/2010 |
| JP | 2012-237203 | 12/2012 |

OTHER PUBLICATIONS

Japanese Patent Office, "Notification of Reasons for Refusal," (1 page) issued in connection with Japanese Patent Application No. 2013-193105, dated Aug. 19, 2015, with its English language Translation (2 pages).

*Primary Examiner* — Jorge Leon, Jr.

(74) *Attorney, Agent, or Firm* — Nixon & Vanderhye P.C.

(57) ABSTRACT

In a valve timing adjusting device, a second rotation body includes a second sun gear part provided inside of a first rotation body, and is connected to a drive shaft or a driven shaft through inside of the sprocket part to be rotated corresponding to the drive shaft or the driven shaft. When the second rotation body is brought into contact with the sprocket part, rotation of the second rotation body relative to the first rotation body is restricted. A planetary rotation body includes a first planetary gear part engaged with the first sun gear part, and a second planetary gear part engaged with the second sun gear part. The planetary rotation body makes a sun-and-planet motion inward of the first sun gear part and the second sun gear part to change a phase of the relative rotation between the first rotation body and the second rotation body.

4 Claims, 7 Drawing Sheets

(56) References Cited

U.S. PATENT DOCUMENTS

| | | | | |
|---|---|---|---|---|
| 2013/0008398 | A1* | 1/2013 | Stoltz-Douchet | F01L 1/344 123/90.15 |
| 2013/0080027 | A1* | 3/2013 | Mikawa | F02D 13/0238 701/102 |
| 2013/0081587 | A1* | 4/2013 | David | F01L 1/344 123/90.17 |
| 2013/0139772 | A1* | 6/2013 | Kamiya | F16D 57/002 123/90.17 |

* cited by examiner

VALVE TIMING ADJUSTING DEVICE

CROSS REFERENCE TO RELATED APPLICATION

This application is based on Japanese Patent Application No. 2013-193105 filed on Sep. 18, 2013, the disclosure of which is incorporated herein by reference.

TECHNICAL FIELD

The present disclosure relates to a valve timing adjusting device.

BACKGROUND

Conventionally, there is known an electric valve timing adjusting device that adjusts valve timing of an engine using rotation torque of a motor. In the electric valve timing adjusting device, a driving side rotation body to which torque of a crankshaft is transmitted, and a driven side rotation body that transmits torque to a camshaft are connected together via a planetary gear. By changing a rotation speed of a planetary rotation body relative to the driving side rotation body by the motor of the valve timing adjusting device, a phase of the driven side rotation body relative to the driving side rotation body is changed, so that opening or closing timing of a valve which is opened or closed by the camshaft is changed.

The valve timing adjusting device has a stopper function of restricting a relative rotation between the driving side rotation body and the driven side rotation body. In JP-A-2012-237203, for example, there is described a valve timing adjusting device in which, when a driven side rotation body rotates relative to a driving side rotation body, a projecting part that is formed radially outward of the driven side rotation body can be in contact with a projecting part that is formed radially inward of the driving side rotation body.

In the valve timing adjusting device described in. JP-A-2012-237203, when opening or closing timing of a valve is set at the most retarded angle or the most advanced angle, a side wall of the projecting part of the driven side rotation body is brought into contact with a side wall of the projecting part of the driving side rotation body. The inertia force of rotational movement of the driven side rotation body is transmitted to the driving side rotation body, The acting force in a radially outward direction acts on the driving side rotation body via bearings of the driving side rotation body and the driven side rotation body. The driving side rotation body includes a sprocket on which, for example, a timing belt is wound, engine torque being transmitted to the timing belt, and an outer gear having relatively high rigidity which is located radially inward of the sprocket and is in engagement with a planetary gear. When the side wall of the projecting part of the driving side rotation body collides with the side wall of the projecting part of the driven side rotation body, the reaction force against the acting force which is caused by the inertia force of rotational movement of the driven side rotation body is applied to the sprocket from the outer gear. This reaction force is applied in a radially outward direction of the sprocket. Accordingly, the sprocket is required to have strength against the acting force and the reaction force applied in the radially outward direction. As a result, the sprocket is increased in size, so that the size of the valve timing adjusting device increases.

SUMMARY

The present disclosure addresses at least one of the above issues. Thus, it is an objective of the present disclosure to provide a valve timing adjusting device whose size is reduced and whose durability is improved.

To achieve the objective of the present disclosure, there is provided a valve timing adjusting device provided for a driving force transmission system for transmitting driving force of an internal combustion engine from a drive shaft to a driven shaft. The valve timing adjusting device adjusts opening and closing timing of at least one of an intake valve and an exhaust valve which are opened or closed by the driven shaft. The valve timing adjusting device includes a first rotation body, a second rotation body, a planetary rotation body, a planetary rotation body carrier, a shaft, and a motor. The first rotation body includes a sprocket part, a first sun gear part, and a covering part. The sprocket part has a synchronization member wound thereon. The synchronization member is synchronized with rotation of one of the drive shaft and the driven shaft. The first rotation body is rotated corresponding to the one of the drive shaft and the driven shaft. The first sun gear part is provided inward of the sprocket part. The covering part is provided radially outward of the sprocket part. The second rotation body includes a second sun gear part provided inside of the first rotation body, and is connected to the other one of the drive shaft and the driven shaft through inside of the sprocket part to be rotated corresponding to the other one of the drive shaft and the driven shaft. The second sun gear part is formed to have an inner diameter that is different from an inner diameter of the first sun gear part. When the second rotation body is brought into contact with the sprocket part, rotation of the second rotation body relative to the first rotation body is restricted. The planetary rotation body includes a first planetary gear part in engagement with the first sun gear part, and a second planetary gear part in engagement with the second sun gear part. The planetary rotation body makes a sun-and-planet motion inward of the first sun gear part and the second sun gear part to change a phase of the relative rotation between the first rotation body and the second rotation body. The planetary rotation body carrier is supported by the covering part and rotatably supports the planetary rotation body. The shaft is connected to the planetary rotation body carrier. The motor is provided on an opposite side of the covering part from the sprocket part and is capable of rotating the shaft.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
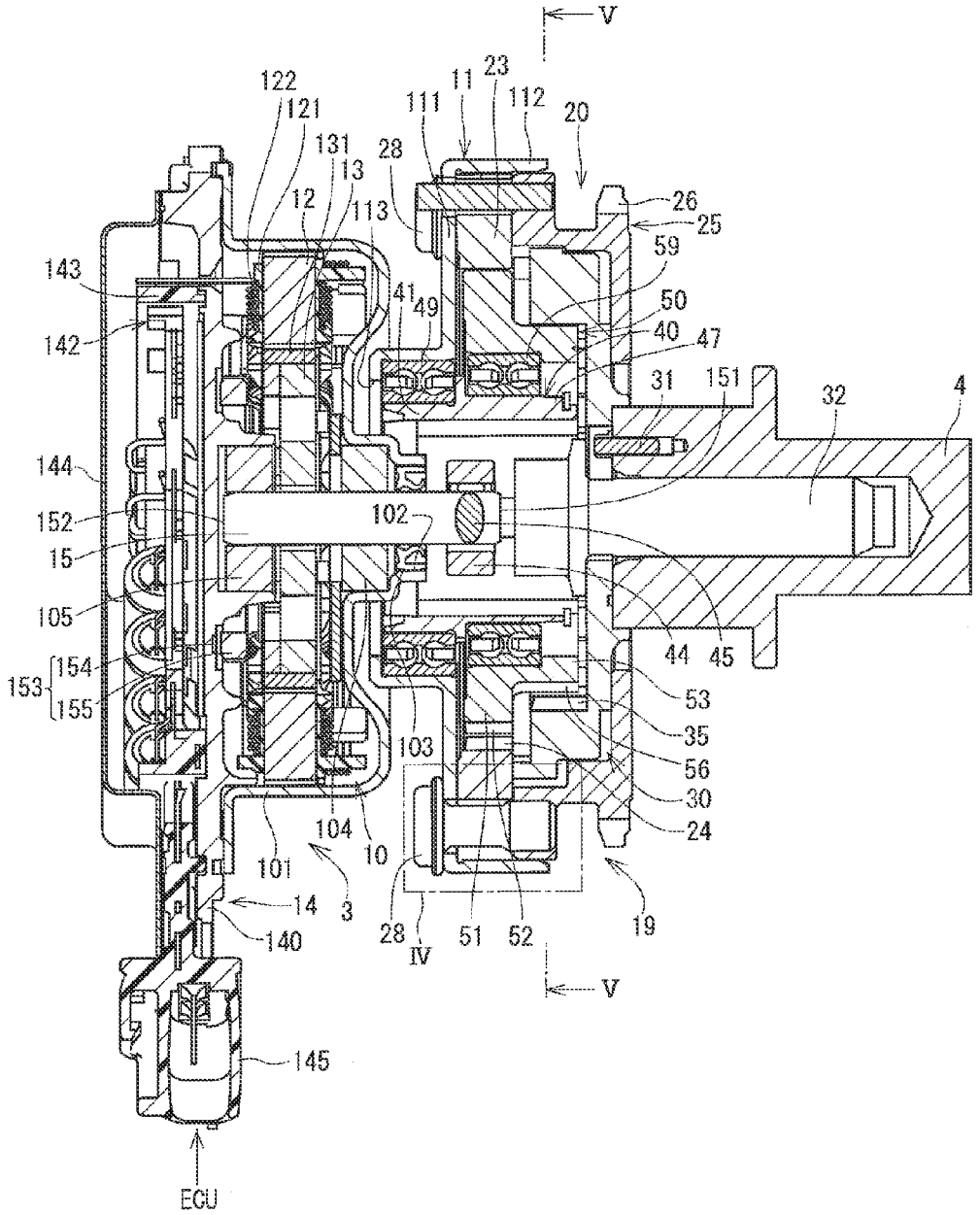
FIG. 1 is a sectional view illustrating a valve timing adjusting device in accordance with a first embodiment.
Figure 2:
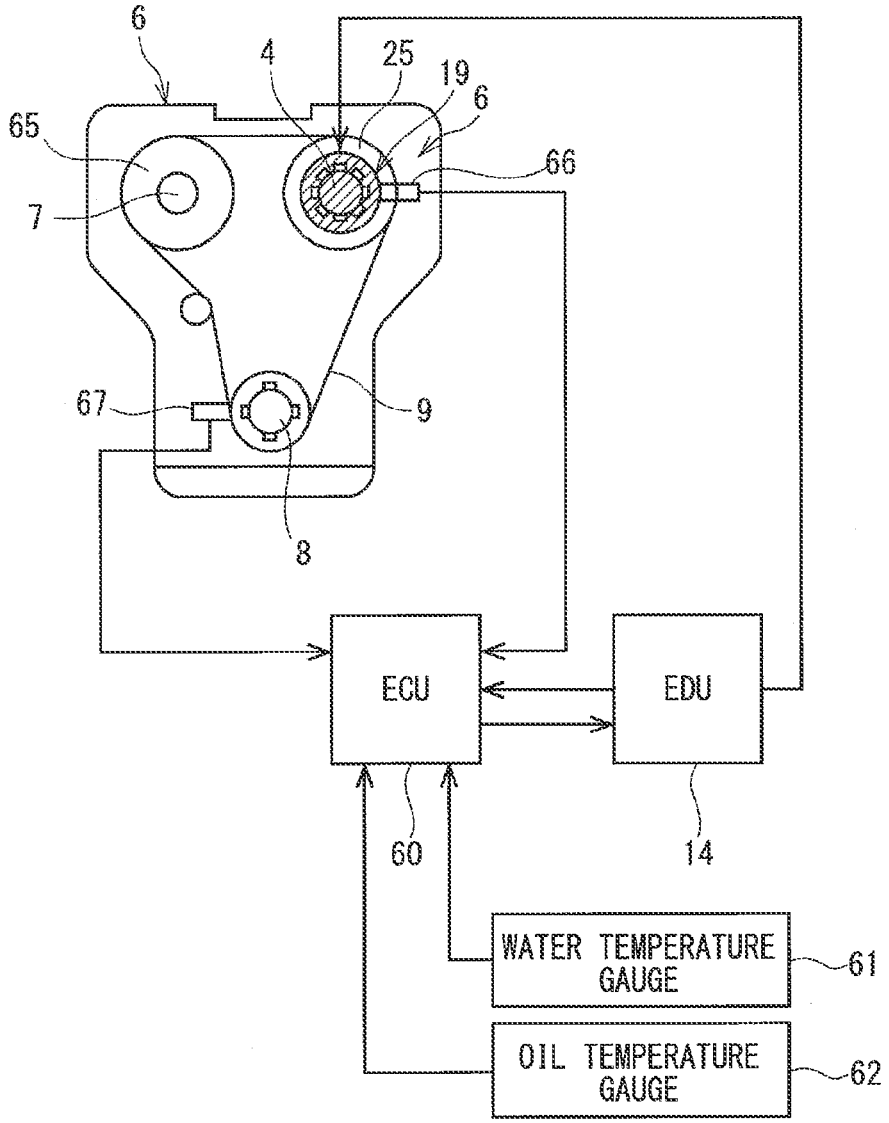
FIG. 2 is a diagram illustrating general configuration of the valve timing adjusting device of the first embodiment and an engine using this valve timing adjusting device.

Embodiments will be described below in reference to the drawings.

(First Embodiment)

A valve timing adjusting device in a first embodiment is illustrated in FIGS. 1 to 5B. A valve timing adjusting device 1 is provided for an engine 6 as a "internal combustion engine" to change a phase of an intake side camshaft 4 as a "driven shaft" relative to a crankshaft 8 as a "drive shaft" (hereinafter referred to as a "camshaft phase") to a predetermined camshaft phase. In the engine 6, opening and closing timing of an intake valve 55 (see FIG. 3) as a "valve" which is opened or closed by the intake side camshaft 4 is changed by the change of the camshaft phase.

In the engine 6, the power from the crankshaft 8 is transmitted respectively to the intake side camshaft 4 and an exhaust side camshaft 7 via sprockets 25, 65 by a timing belt 9 as a "synchronization member". On an outer peripheral side of the intake side camshaft 4, there is attached a cam angle sensor 66 that outputs a signal in accordance with a rotation angle of the intake side camshaft 4 (hereinafter referred to as a "camshaft angle") in synchronization with the rotation of the intake side camshaft 4. On the other hand, on an outer peripheral side of the crankshaft 8, there is attached a crank angle sensor 67 that outputs a signal in accordance with a rotation angle of the crankshaft 8 (hereinafter referred to as a "crankshaft angle")in synchronization with the rotation of the crankshaft 8. The signals in accordance with the camshaft angle detected by the cam angle sensor 66, and the crankshaft angle detected by the crank angle sensor 67 are inputted into an ECU 60.

The ECU 60 is constituted mainly of a microcomputer, and controls the fuel injection amount of a fuel injection valve or ignition timing of an ignition plug in accordance with an engine operating condition through the execution of various kinds of engine control programs stored in an integrated ROM (storage medium). Into the ECU 60, in addition to the camshaft angle and the crankshaft angle, there is inputted, for example, a signal in accordance with each of the temperature of lubricating oil lubricating the inside of the engine 6 which is detected by an oil temperature gauge 62, and the temperature of coolant cooling the engine 6 which is detected by a water temperature gauge 61. The ECU 60 calculates an actual camshaft phase based on these inputted signals, and calculates a target camshaft phase in accordance with the engine operating conditions. The ECU 60 calculates target rotation of a motor 10 based on the target camshaft phase, and a signal in accordance with the calculated target rotation is outputted to a motor drive control unit (hereinafter referred to as an "EDU") 14.

Figure 3:
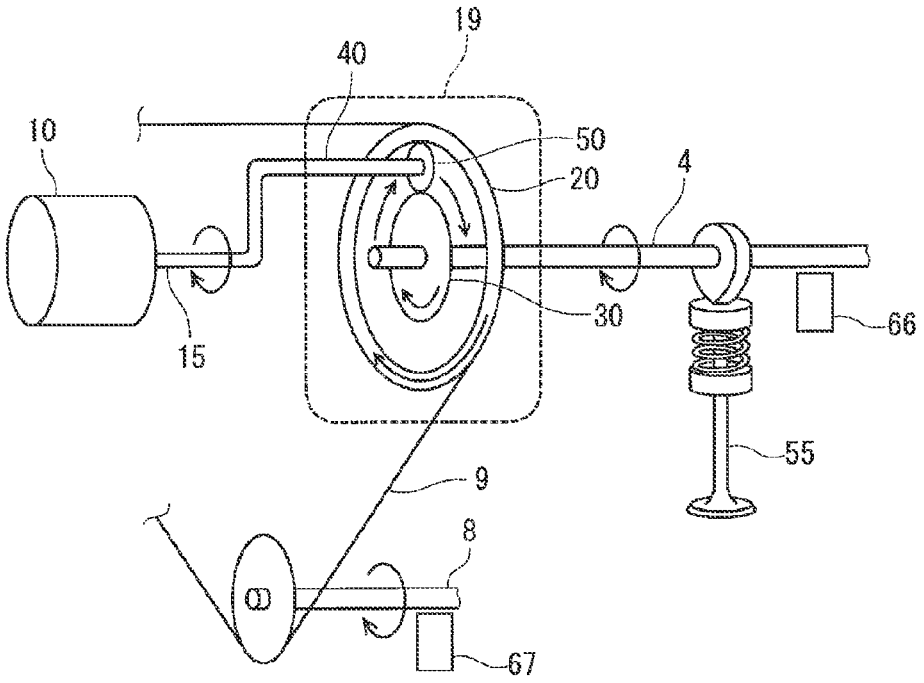
FIG. 3 is a diagram illustrating general configuration of the valve timing adjusting device of the first embodiment.
Figure 4:
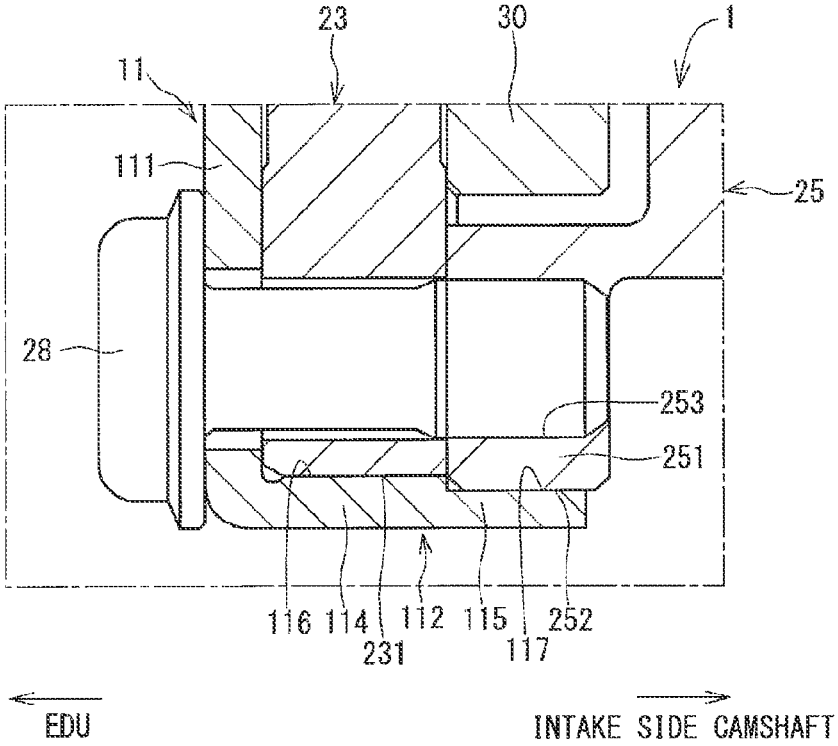
FIG. 4 is a sectional view illustrating a main portion of the valve timing adjusting device of the first embodiment.

The EDU 14 passes an electric current in accordance with the target rotation outputted by the ECU 60 through the motor 10 (see FIGS. 1 and 3). The EDU 14 feeds back to the ECU 60, for example, a rotation state of a shaft 15 of the motor 10 (see FIGS. 1 and 3) detected by a rotation angle sensor 153 (see FIG. 1) integrated in the EDU 14.

FIG. 1 is a sectional view illustrating a motor assembly 3 and a converting part 19 of the valve timing adjusting device 1. The motor assembly 3 includes the EDU 14 that outputs an electric current, the motor 10 that produces rotation torque by the electric current outputted by the EDU 14, and a case 101 that accommodates the EDU 14 and the motor 10. The converting part 19 adjusts the camshaft phase by the rotation torque outputted by the motor 10.

The EDU 14 includes a circuit part 142 having various kinds of electronic components mounted on a substrate, the connecting part 143 electrically connected to the motor 10, and a connector 145 electrically connecting together the EDU 14 and the motor 10, and the outside. The circuit part 142 and the connecting part 143, for example, are accommodated in a space defined by a base 140 that is provided approximately perpendicular to the intake side camshaft 4, and a cover 144 that is provided on an opposite side of the base 140 from the converting part 19.

The circuit part 142 includes a substrate for control and a substrate for power. On the substrate for control, there are mounted, for example, the rotation angle sensor 153 that detects the rotation angle of the shaft 15, and a custom IC that controls a rotation speed of the shaft 15 and prevents an overcurrent. A power MOS that controls the energizing amount and so forth are mounted on the power substrate. The power substrate also has a function of releasing the heat produced by the power MOS.

The connecting part 143 is formed from a cylindrical resin member having a generally rectangular shape. Electronic components such as a capacitor are provided for the connecting part 143. The connector 145 is provided radially outward of the connecting part 143. The connector 145 is formed integrally with the connecting part 143, and is located at a notched part which is formed at the base 140 when the connecting part 143 is incorporated into the base 140. The connector 145 is used for an electric connection between the various kinds of electronic components mounted on the connecting part 143 and the circuit part 142, and the external ECU 60, a battery (not shown) or the like.

The motor 10 is, for example, an electric motor which is a brush-less motor, and includes a stator 12, a rotor 13, and the shaft 15. The stator 12, the rotor 13, and so forth are accommodated in a space formed by the case 101 and the base 140 of the EDU 14.

One end portion 151 of the shaft 15 is inserted through an opening 102 which is formed at a bottom part of the case 101. An oil seal 103 that can prevent the entry of liquid and gas into the case 101 is provided between the opening 102 and the shaft 15. A bearing 104 that rotatably supports the shaft 15 is provided on an opposite side of the oil seal 103 from the converting part 19. The other end portion 152 of the shaft 15 is supported rotatably by a bearing 105 which is provided coaxially with the bearing 104 on the converting part 19-side of the base 140. Accordingly, the shaft 15 is supported rotatably relative to the case 101 and the base 140 via the bearings 104, 105.

A bobbin 121 is provided for the stator 12 on an axially outer side. A coil 122 is wound around the bobbin 121. Upon energization of the coil 122, a magnetic field is generated in the stator 12. The rotor 13 that rotates integrally with the shaft 15 is provided radially inward of the stator 12. A magnet 131 is provided radially outward of the rotor 13 such that a north pole and south pole are alternately arranged. Accordingly, the rotor 13 is rotated integrally with the shaft 15 by the magnetic field generated upon energization of the coil 122 of the stator 12.

A magnet 155 of the rotation angle sensor 153 that detects the rotation angle of the shaft 15 is provided for the motor 10. The rotation angle sensor 153 detects the rotation angle of the shaft 15 based on a position relative to a Hall element 154 and the magnet 155 provided on the converting part 19-side of the base 140.

The converting part 19 adjusts a cam phase by a change of a rotating speed of the motor 10, and includes an outer rotor 20, an inner rotor 30, an eccentric shaft 40, and a planetary gear 50.

The outer rotor 20 is formed in an approximately cylindrical shape and accommodates therein the inner rotor 30, the eccentric shaft 40, the planetary gear 50, and so forth. The outer rotor 20 includes a cover 11 as a "covering part", an outer gear 23 as a "first sun gear part", and the sprocket 25 as a "sprocket part". The outer gear 23 and a part of the sprocket 25 are accommodated in the cover 11, which is provided on the EDU 14-side. The cover 11, the outer gear 23, and the sprocket 25 are fixed together by a bolt 28. The outer rotor 20 may correspond to a "first rotation body".

The cover 11 is formed from a material having lower rigidity than the outer gear 23 and the sprocket 25 and a relatively large displacement with respect to the magnitude of applied force. The cover 11 includes a bottom part 111 and a cylindrical part 112, and has a nearly cylindrical shape. A bearing 49 that supports the eccentric shaft 40 rotatably relative thereto is provided for the cover 11. An opening 113 is formed at the bottom part 111. A part of the case 101 and the one end portion 151-side of the shaft 15 are inserted through the opening 113. The cylindrical part 112 is provided radially outward of the outer gear 23 and the sprocket 25. A detailed shape of the cover 11 will be described later.

The outer gear 23 is formed from a material having relatively high rigidity, and is provided radially inward of the sprocket 25. A driving side internal gear part 24 that is in engagement with a driving side external gear part 52 of the planetary gear 50 is formed radially inward of the sprocket 25.

The sprocket 25 includes teeth 26, which project in the radially outward direction, in the rotation direction. The timing belt 9 is held over between these teeth 26 and teeth which are formed on the crankshaft 8. Accordingly, when the torque outputted by the rotation of the crankshaft 8 is inputted into the sprocket 25 via the timing belt 9, the outer rotor 20 rotates in synchronization with the crankshaft 8.

The inner rotor 30 is formed in a cylindrical shape with a bottom, and is arranged coaxially with the outer rotor 20. The circumferential position of the inner rotor 30 relative to the intake side camshaft 4 is determined by a pin 31, and the inner rotor 30 is fixed to the intake side camshaft 4 by a center bolt 32. Accordingly, the inner rotor 30 rotates integrally with the intake side camshaft 4. The inner rotor 30 is provided rotatably relative to the outer rotor 20. The inner rotor 30 may correspond to a "second rotation body".

A driven side internal gear part 35 is formed radially inward of the inner rotor 30. The driven side internal gear part 35 as a "second sun gear part" is provided on the intake side camshaft 4-side of the driving side internal gear part 24 in the axial direction.

The eccentric shaft 40 includes an input part 41 that is provided on the EDU 14-side, and an eccentric part 47 that is provided on the intake side camshaft 4-side, and is formed cylindrically as a whole. The eccentric shaft 40 as a "planetary rotation body carrier" is connected to the shaft 15 through a motor joint 44 and a joint pin 45.

The input part 41 is arranged coaxially with the outer rotor 20 and the inner rotor 30. The input part 41 is supported rotatably by the bearing 49 which is provided for the cover 11. Accordingly, the eccentric shaft 40 is provided rotatably relative to the outer rotor 20.

The eccentric part 47 is provided to be eccentric with respect to the input part 41. Accordingly, the eccentric part 47 is provided to be eccentric with respect to both the outer rotor 20 and the inner rotor 30.

The planetary gear 50 is provided radially outward of the eccentric part 47 of the eccentric shaft 40. A bearing 59 is provided between the eccentric part 47 and the planetary gear 50. Accordingly, the planetary gear 50 is supported by the eccentric shaft 40 to be capable of sun-and-planet motion in accordance with the rotation of the eccentric shaft 40 relative to the outer rotor 20. This sun-and-planet motion refers to such a motion that the planetary gear 50 rotates around the eccentric central line of the eccentric part 47 and revolves in the rotation direction of the eccentric shaft 40.

The planetary gear 50 includes a large diameter part 51 provided on the EDU 14-side, and a small diameter part 53 provided on the intake side camshaft 4-side, and is formed in an approximately cylindrical shape. The driving side external gear part 52 is formed radially outward of the large diameter part 51 as a "first planetary gear part", and a driven side external gear part 56 is formed radially outward of the small diameter part 53 as a "second planetary gear part". The driving side external gear part 52 is disposed on an inner peripheral side of the driving side internal gear part 24 and is engaged with the driving side internal gear part 24. The driven side external gear part 56 is disposed on an inner peripheral side of the driven side internal gear part 35, and is engaged with the driven side internal gear part 35. In the first embodiment, the large diameter part 51 having a comparatively large outer diameter is provided on the EDU 14-side, and the small diameter part 53 having a comparatively small outer diameter is provided on the intake side camshaft 4-side. Alternatively, a small diameter part having a comparatively small outer diameter may be provided on the EDU 14-side, and a large diameter part having a comparatively large outer diameter may be provided on the intake side camshaft 4-side. The planetary gear 50 may correspond to a "planetary rotation body".

In the converting part 19, the rotation torque of the outer rotor 20 is transmitted to the inner rotor 30 by the above-described configuration. In the converting part 19, when a whirl speed of the planetary gear 50 relative to a rotation speed of the outer rotor 20 is changed, a rotation angle of the inner rotor 30 relative to the outer rotor 20 is adjusted. Accordingly, a phase of the intake side camshaft 4, which rotates integrally with the inner rotor 30, relative to the crankshaft 8, i.e., the camshaft phase, is adjusted, and the opening or closing timing of the intake valve 55 which is opened or closed by the intake side camshaft 4 is thereby adjusted.

The valve timing adjusting device 1 of the first embodiment is characterized in the shape of the cover 11 of the converting part 19. Details of the shape of the cover 11 will be described with reference to FIG. 4.

The cylindrical part 112 of the cover 11 is formed to extend from the bottom part 111 toward the intake side camshaft 4, and is provided radially outward of a rim part 251, which is provided radially outward of the outer gear 23 and on the EDU 14-side of the sprocket 25. The cylindrical part 112 restricts the extension of the rim part 251 in a radially outward direction.

The cylindrical part 112 includes a small inner diameter part 114 and a large inner diameter part 115 whose inner diameters are different from each other. The small inner diameter part 114 is provided on the bottom part 111-side of the cylindrical part 112. The small inner diameter part 114 is formed such that its inner diameter is almost the same as the outer diameter of the outer gear 23. An outer wall 231 of the outer gear 23 is in contact with an inner wall 116 of the small inner diameter part 114. The large inner diameter part 115 is provided on an opposite side of the small inner diameter part 114 from the bottom part 111. The large inner diameter part 115 is formed such that its inner diameter is larger than the inner diameter of the small inner diameter part 114 and approximately the same as the outer diameter of the rim part 251 of the sprocket 25. An outer wall 252 of the rim part 251 is in contact with an inner wall 117 of the large inner diameter part 115. A screw hole 253 whose inner wall includes a thread groove is formed through the rim part 251 of the sprocket 25. When the outer gear 23 and the sprocket 25 are attached to the cover 11, the outer gear 23 and the sprocket 25 are attached to the cover 11, being aligned (centered) relative to the cover 11 to ensure the performance and reliability of the converting part 19.

(1) In the valve timing adjusting device 1 of the first embodiment, the cover 11, which is provided radially outward of the sprocket 25, reduces the acting force in a radially outward direction which is applied to the sprocket 25. The acting force applied to the sprocket 25 will be described with reference to FIGS. 5A and 5B.

Figure 5A:
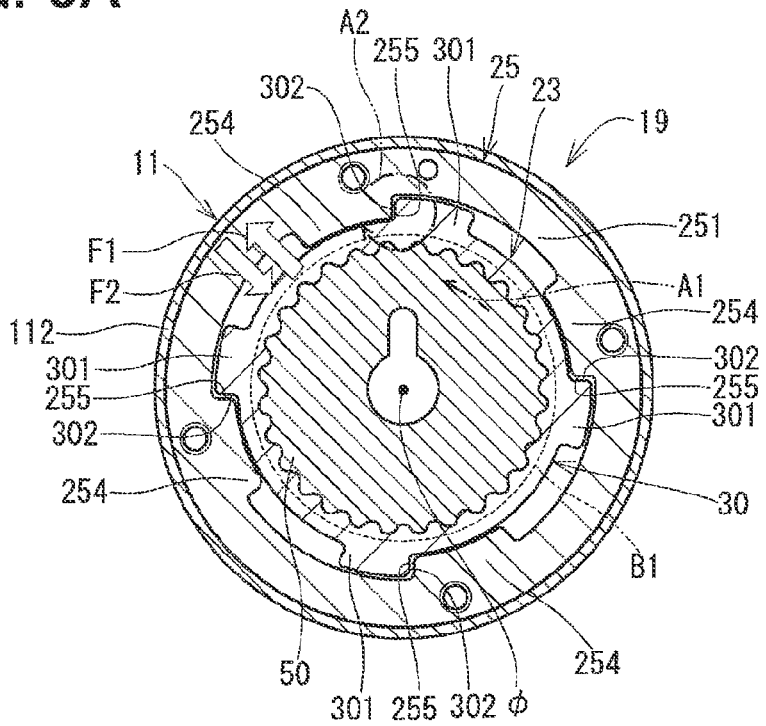
FIG. 5A is a cross-sectional view illustrating the valve timing adjusting device of the first embodiment.
Figure 5B:
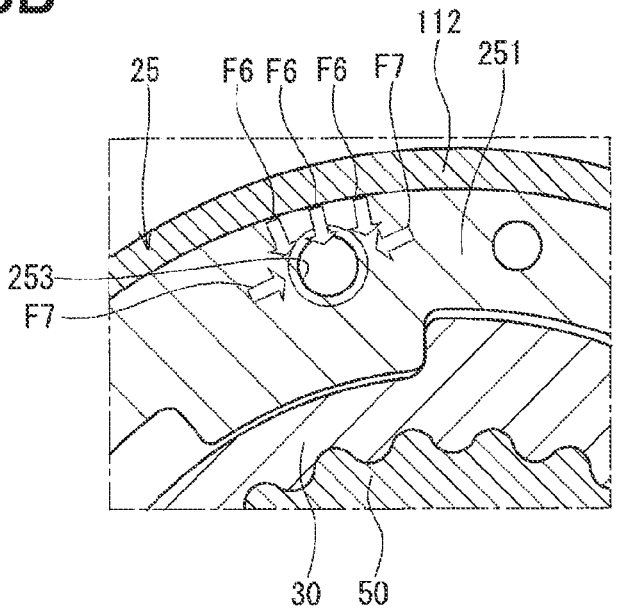
FIG. 5B is a partially enlarged view illustrating the valve timing adjusting device in FIG. 5A.

FIGS. 5A and 5B are cross-sectional views taken along a line V-V in FIG. 1, and illustrate a positional relationship between the sprocket 25 and the inner rotor 30 when the opening and closing timing of the intake valve 55 is the most retarded angle. In the valve timing adjusting device 1, when the opening and closing timing of the intake valve 55 is the most retarded angle, the sprocket 25 of the outer rotor 20 and the inner rotor 30 are brought into contact with each other, so that a phase of rotation of the inner rotor 30 relative to the sprocket 25 is restricted. Although the case of the opening and closing timing of the intake valve 55 being the most retarded angle is described here, the same is true in the case of the opening and closing timing being the most advanced angle, In addition, the same is true in a case of opening and closing timing of an exhaust valve being the most retarded angle or the most advanced angle.

The sprocket 25 includes radially inward of the rim part 251 a projecting part 254 which projects in a radially inward direction. In the valve timing adjusting device 1 of the first embodiment, the four projecting parts 254 are provided as illustrated in FIG. 5A. The inner rotor 30 includes a projecting part 301 radially outward of the inner rotor 30. In the valve timing adjusting device 1 of the first embodiment, the four projecting parts 301 are provided. In the converting part 19, the projecting part 301 is located between its adjacent projecting parts 254, and is reciprocated between the adjacent projecting parts 254 at the time of the rotation of the inner rotor 30 relative to the sprocket 25 with the central axis $\phi$ as its rotation center.

When the opening and closing timing of the intake valve 55 is the most retarded angle, a circumferential side wall 302 of the projecting part 301 is brought into contact with a circumferential side wall 255 of the projecting part 254, as illustrated in FIG. 5A. In this manner, the valve timing adjusting device 1 has a "stopper function" of restricting the rotation of the inner rotor 30 relative to the sprocket 25. In this case, the inertia force of rotational movement of the inner rotor 30 rotating relative to the sprocket 25 as indicated by an arrow A1 with an alternate long and two short dashes line is applied to the side wall 255 of the projecting part 254 of the sprocket 25. The force caused by the inertia force of rotational movement of the inner rotor 30 which is applied to the sprocket 25 acts to rotate the sprocket 25 with the side wall 255 of the projecting part 254 as the rotation center as indicated by an arrow A2 with an alternate long and two short dashes line. Accordingly, the acting force Fl in the radially outward direction is applied to a bearing B1 (dotted line in FIG. 5A) of the sprocket 25 and the inner rotor 30. When the acting force Fl acts on the sprocket 25, the reaction force F2 against the acting force Fl is applied in a direction radially inward of the sprocket 25 by the cylindrical part 112 of the cover 11 located radially outward of the sprocket 25. Accordingly, the load applied to the sprocket 25 is reduced.

As a comparative example, with reference to FIGS. 7A and 7B, there will be described a relationship of the acting force in a valve timing adjusting device in which a cylindrical part of a cover does not cover a radially outward part of a sprocket.

Figure 7A:
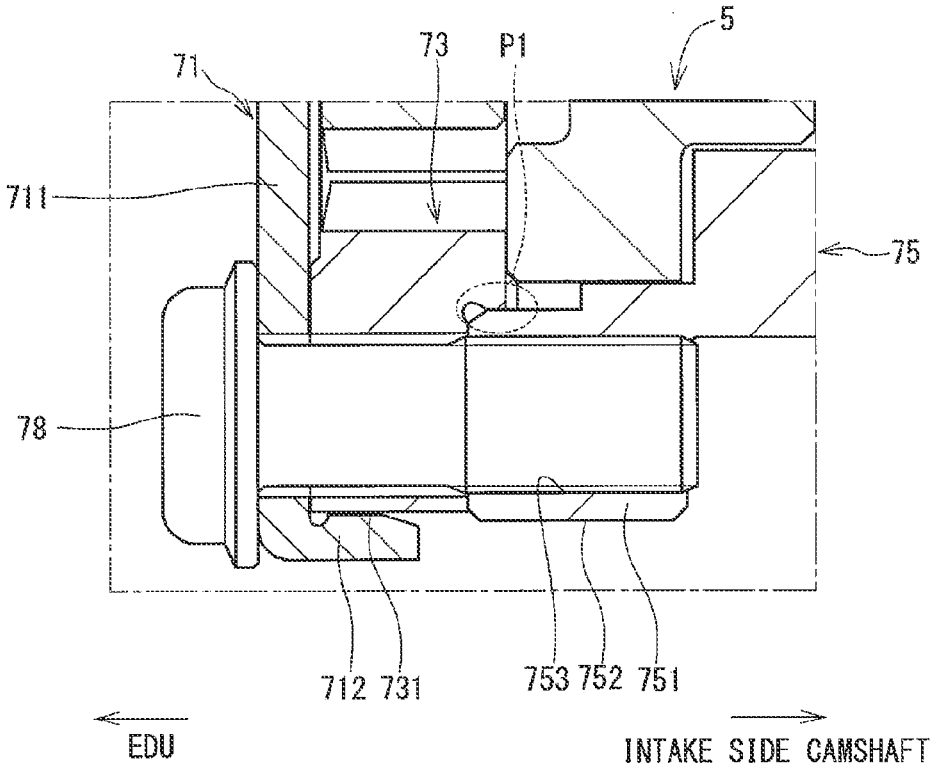
FIG. 7A RELATED ART
FIG. 7A is a sectional view illustrating a valve timing adjusting device in a comparative example.

In a valve timing adjusting device 5 of the comparative example, a cover 71 includes a bottom part 711 and a cylindrical part 712 as illustrated in FIG. 7A. The cylindrical part 712 is formed to extend from the bottom part 711 in a direction of an intake side camshaft. However, the cylindrical part 712 is formed to cover an outer wall 731 of an outer gear 73, but is not formed to cover an outer wall 752 of a rim part 751 of a sprocket 75.

Figure 7B:
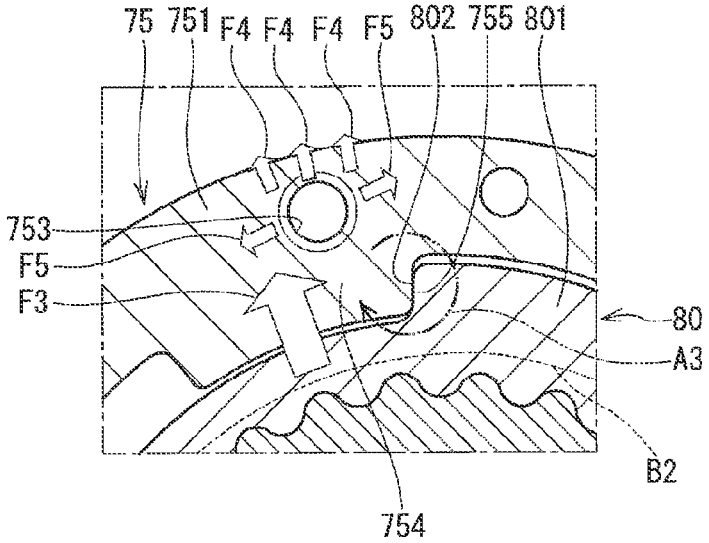
FIG. 7B RELATED ART
FIG. 7B is a partially enlarged view illustrating a sprocket and an inner rotor in the comparative example.

In the valve timing adjusting device 5 of the comparative example, when the opening and closing timing of an intake valve is the most retarded angle, as illustrated in FIG. 7B, a side wall 802 of a projecting part 801 provided at a radially outward part of an inner rotor 80 comes into contact with a side wall 755 of a projecting part 754 provided at a radially inward part of the sprocket 75. In this case, as described above, the force is applied to the projecting part 754 of the sprocket 75 to rotate as indicated by an arrow A3 with an alternate long and two short dashes line due to the inertia force of rotational movement of the inner rotor 80. Accordingly, the acting force F3 in the radially outward direction acts on a bearing B2 of the sprocket 75 and the inner rotor 80. However, in the valve timing adjusting device 5 of the comparative example, the radially outward part of the sprocket 75 is not covered, and thus the load applied to the sprocket 75 corresponds to the acting force F3. For this reason, strength against the acting force F3 is required for the sprocket 75 alone, thereby increasing the thickness of the sprocket 75. As a result, the valve timing adjusting device 5 grows in size. On the other hand, in the valve timing adjusting device 1 of the first embodiment, the acting force Fl in the radially outward direction acting on the sprocket 25 is received by the cover 11 provided radially outward of the sprocket 25. Consequently, damage to the valve timing adjusting device 1 can be prevented and reduced in size. Therefore, the valve timing adjusting device 1 can be reduced in size and endurance against the damage to the device 1 can be improved.

(2) In the valve timing adjusting device 5 of the comparative example, as illustrated in FIG. 7A, the outer gear 73 is press-fitted and fixed to the sprocket 75 (see a press-fitted and fixed portion P1 in FIG. 7A). Accordingly, the acting force F4 due to the press-fitting is applied to a screw hole 753 of the rim part 751 of the sprocket 75 in a radially outward direction as illustrated in FIG. 7B. Moreover, because of the acting force F4 due to the press-fitting, the tension F5 extending the screw hole 753 in the circumferential direction is applied to the screw hole 753. A thread groove is formed on an inner wall of the screw hole 753, and particularly, its root portion has small strength against the tension, so that the sprocket 75 may be damaged if a stress is concentrated thereon. For this reason, the length of the sprocket 75 in its axial direction needs to be lengthened to prevent the damage to the sprocket 75, and a bolt 78 for fixing together the cover 71 and the sprocket 75 needs to be lengthened, for example, by providing a spot facing to avoid the stress concentration on the bolt 78. On the other hand, in the valve timing adjusting device 1 of the first embodiment, as illustrated in FIG. 5B, the acting force F6, which is a reaction force against the acting force due to the press-fitting of the sprocket 25 into the cover 11, is applied to the screw hole 253 of the sprocket 25 in a radially inward direction. In addition, the compressive force F7 compressing the screw hole 253 in the circumferential direction acts on the screw hole 253 because of the acting force F6. As a consequence, endurance of the concentrated stress is improved, so that the sprocket 25 and the bolt 28 can be reduced in size. Thus, the endurance of the damage to the valve timing adjusting device 1 can be improved and reduced further in size.

(3) In the valve timing adjusting device 5 of the comparative example, at the time of assembly of a converting part, the outer gear 73 is press-fitted and fixed to the cover 71, and then the sprocket 75 is press-fitted and fixed to the outer gear 73. In this case, the outer gear 73, which is aligned (centered) with the cover 71, is to be aligned with the sprocket 75. Therefore, in the valve timing adjusting device 5 of the comparative example, the alignment of the sprocket 75 is performed on the outer gear 73, which is aligned with the cover 71. Accordingly, accuracy in alignment (centering) may be decreased. On the other hand, in the valve timing adjusting device 1 of the first embodiment, the outer gear 23 and the sprocket 25 are aligned (centered) relative to the cover 11. The cover 11 can be formed by concentrically working the inner walls 116, 117 of the cylindrical part 112. As a result, by aligning (centering) relative to the cover 11 which is a single member, the accuracy in alignment (centering) of the outer gear 23 and the sprocket 25 can be improved.

(Second Embodiment)

Figure 6:
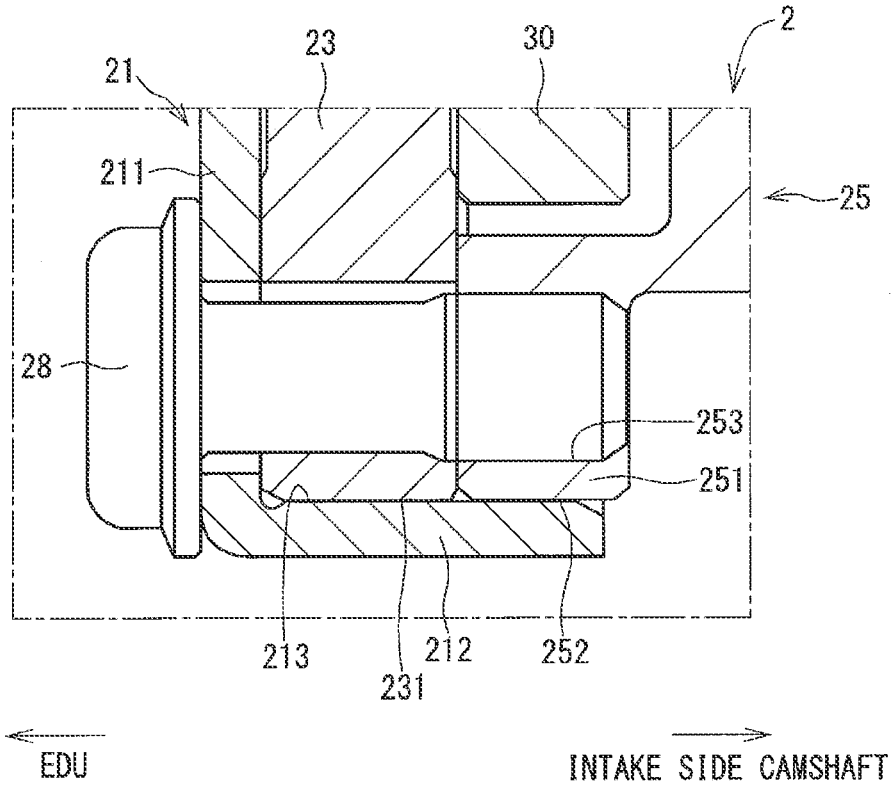
FIG. 6 is a sectional view illustrating a main portion of a valve timing adjusting device in accordance with a second embodiment.

A valve timing adjusting device of a second embodiment will be described with reference to FIG. 6. The second embodiment is different from the first embodiment in shape of a cylindrical part of a cover. For substantially the same component parts as the first embodiment, the same corresponding reference numerals are used to omit their descriptions.

In a valve timing adjusting device 2 of the second embodiment, a cover 21 includes a bottom part 211 and a cylindrical part 212. The cylindrical part 212 is a cylindrical part whose inner diameter is constant, and an outer wall 231 of an outer gear 23 and an outer wall 252 of a rim part 251 of a sprocket 25 are in contact with an inner wall 213 of the cylindrical part 212.

In the valve timing adjusting device 2 of the second embodiment, alignment (centering) of the outer gear 23 and the sprocket 25 is performed on the inner wall 213 of the cylindrical part 212 of the cover 21. The inner wall 213 of the cylindrical part 212 has a constant inner diameter, and is thus formed with working accuracy of a small error. Accordingly, the central axes of the outer gear 23 and the sprocket 25, which are positioned relative to the inner wall 213 of the cylindrical part 212, easily accord with each other. Thus, the valve timing adjusting device 2 of the second embodiment can further improve the accuracy in alignment (centering) in addition to the effects (1) (2) of the first embodiment.

In the above embodiments, the outer gear and the sprocket are press-fitted fixed to the cover. However, the method of attaching the outer gear and the sprocket to the cover is not limited to this mode. In the above embodiments, the bolt is used as a member for fixing together the cover, the outer gear, and the sprocket. However, the member for fixing together the cover, the outer gear, and the sprocket is not limited to the bolt. Modifications to the above embodiments will be described below.

In the above embodiments, as the "stopper function", there are provided the four projecting parts, which project in a radially inward direction, radially inward of the sprocket; and the four projecting parts, which project in a radially outward direction, radially outward of the inner rotor. However, the number of projecting parts is not limited to four. Any number of projecting part(s) may be formed as long as they have the "stopper function" whereby the rotation of the inner rotor is restricted by its contact with the sprocket.

In the above embodiments, the cover is formed from a material having lower rigidity than the outer gear and the sprocket and a relatively large displacement with respect to the magnitude of applied force. However, the material which is formed into the cover is not limited to such a material.

In the above embodiments, the member for transmitting the engine torque is the timing belt. However, the member for transmitting the engine torque is not limited to the timing belt.

In the above embodiments, the outer rotor includes the cover as the "covering part", the outer gear as the "first sun gear part", and the sprocket as the "sprocket part", and they are formed respectively by separate members. However, the configuration of the outer rotor is not limited to the above, and the "covering part", the "first sun gear part", and the "sprocket part" do not need to be formed by separate members. For example, the teeth of the sprocket, over which the timing belt or the like is held, may be formed on the cover. Additionally, the outer gear and the sprocket may be formed integrally, or the cover and the sprocket may be formed integrally.

The present disclosure is not limited to these embodiments, and can be embodied in various modes without departing from the scope of the disclosure.

To sum up, the valve timing adjusting device 1, 2 of the above embodiments can be described as follows.

A valve timing adjusting device 1 is provided for a driving force transmission system for transmitting driving force of an internal combustion engine 6 from a drive shaft 8 to a driven shaft 4, 7. The valve timing adjusting device 1 adjusts opening and closing timing of at least one of an intake valve 55 and an exhaust valve which are opened or closed by the driven shaft 4, 7. The valve timing adjusting device 1 includes a first rotation body 20, a second rotation body 30, a planetary rotation body 50, a planetary rotation body carrier 40, a shaft 15, and a motor 10. The first rotation body 20 includes a sprocket part 25, a first sun gear part 23, and a covering part 11, 21. The sprocket part 25 has a synchronization member 9 wound thereon. The synchronization member 9 is synchronized with rotation of one of the drive shaft 8 and the driven shaft 4, 7. The first rotation body 20 is rotated corresponding to the one of the drive shaft 8 and the driven shaft 4, 7. The first sun gear part 23 is provided inward of the sprocket part 25. The covering part 11, 21 is provided radially outward of the sprocket part 25. The second rotation body 30 includes a second sun gear part 35 provided inside of the first rotation body 20, and is connected to the other one of the drive shaft 8 and the driven shaft 4, 7 through inside of the sprocket part 25 to be rotated corresponding to the other one of the drive shaft 8 and the driven shaft 4, 7. The second sun gear part 35 is formed to have an inner diameter that is different from an inner diameter of the first sun gear part 23. When the second rotation body 30 is brought into contact with the sprocket part 25, rotation of the second rotation body 30 relative to the first rotation body 20 is restricted. The planetary rotation body 50 includes a first planetary gear part 51 in engagement with the first sun gear part 23, and a second planetary gear part 53 in engagement with the second sun gear part 35. The planetary rotation body 50 makes a sun-and-planet motion inward of the first sun gear part 23 and the second sun gear part 35 to change a phase of the relative rotation between the first rotation body 20 and the second rotation body 30. The planetary rotation body carrier 40 is supported by the covering part 11, 21 and rotatably supports the planetary rotation body 50. The shaft 15 is connected to the planetary rotation body carrier 40. The motor 10 is provided on an opposite side of the covering part 11, 21 from the sprocket part 25 and is capable of rotating the shaft 15.

In the valve timing adjusting device 1, 2 of the present embodiments, when the second rotation body 30 comes into contact with the sprocket part 25 of the first rotation body 20, the rotation of the second rotation body 30 relative to the first rotation body 20 is restricted. In this case, the second rotation body 30 has the inertia force in the rotation direction. Accordingly, when the sprocket part 25 stops the rotation of the second rotation body 30, the acting force caused by this inertia force is applied to extend the sprocket part 25 in the radially outward direction. In the valve timing adjusting device 1, 2 of the present embodiments, the covering part 11, 21 is provided radially outward of the sprocket part 25. Consequently, the acting force caused by the inertia force is received by the covering part 11, 21. As a result, high strength does not need to be ensured for the sprocket part 25, thereby reducing the sprocket part 25 in size. Thus, the damage to the sprocket part 25 can be prevented with the size of the valve timing adjusting device 1, 2 reduced.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

What is claimed is:

1. A valve timing adjusting device for a driving force transmission system for transmitting driving force of an internal combustion engine from a drive shaft to a driven shaft, the valve timing adjusting device being configured to adjust opening and closing timing of at least one of an intake valve and an exhaust valve which are opened or closed by the driven shaft, the valve timing adjusting device comprising:

a first rotation body that includes:

a sprocket part having a synchronization member wound thereon, wherein:

the synchronization member is synchronized with rotation of one of the drive shaft and the driven shaft; and the first rotation body is configured to rotate corresponding to the one of the drive shaft and the driven shaft;

a first sun gear part inward of the sprocket part; and a cylindrical covering part radially outward of the sprocket part and the first sun gear part, wherein an outer wall of the sprocket part and an outer wall of the first sun gear part are in contact with an inner wall of the covering part;

a second rotation body that includes a second sun gear part inside of the first rotation body and that is connected to the other one of the drive shaft and the driven shaft through an inside of the sprocket part to be rotated corresponding to the other one of the drive shaft and the driven shaft, wherein:

the second sun gear part has an inner diameter that is different from an inner diameter of the first sun gear part; and when the second rotation body is brought into contact with the sprocket part, rotation of the second rotation body relative to the first rotation body is restricted;

a planetary rotation body that includes a first planetary gear part in engagement with the first sun gear part, and a second planetary gear part in engagement with the second sun gear part, wherein the planetary rotation body makes a sun-and-planet motion inward of the first sun gear part and the second sun gear part to change a phase of the relative rotation between the first rotation body and the second rotation body;

a planetary rotation body carrier that is supported by a radially inward end portion of the covering part and rotatably supports the planetary rotation body radially inward of the planetary rotation body;

a shaft that is connected to the planetary rotation body carrier; and a motor on an opposite side of the covering part from the sprocket part and is capable of rotating the shaft.

2. The valve timing adjusting device according to claim 1, further comprising a bolt that is screw-joined to a rim part of the sprocket part located radially inward of the covering part wherein the first sun gear part and the sprocket part are attached to the covering part and then the first sun gear part, the sprocket part, and the covering part are fixed together by the bolt.

3. The valve timing adjusting device according to claim 1, wherein the covering part includes:

a cylindrical small inner diameter part having an inner diameter which is the same in size as an outer diameter of the first sun gear part; and a cylindrical large inner diameter part having an inner diameter that is the same in size as an outer diameter of the sprocket part, which is larger than the outer diameter of the first sun gear part.

4. The valve timing adjusting device according to claim 1, wherein:

the covering part has an inner diameter that is the same in size as an outer diameter of the first sun gear part and as an outer diameter of the sprocket part; and the covering part has the same central axis as those of the first sun gear part and the sprocket part.

* * * * *